United States Patent [19]

Scott

[11] 4,340,098

[45] Jul. 20, 1982

[54] LOG SPLITTER AND ATTACHMENT FOR TRACTOR

[76] Inventor: George K. Scott, 111 Rte. 306, Suffern, N.Y. 10901

[21] Appl. No.: 203,599

[22] Filed: Nov. 3, 1980

[51] Int. Cl.[3] ..... B27L 7/00

[52] U.S. Cl. ..... 144/193 A; 144/193 R

[58] Field of Search ..... 144/193 F, 193 A

[56] References Cited

FOREIGN PATENT DOCUMENTS 2711689 9/1978 Fed. Rep. of Germany ... 144/193 A 605068 9/1978 Switzerland ..... 144/193 R

*Primary Examiner*—W. D. Bray

*Attorney, Agent, or Firm*—Charles E. Baxley

[57] ABSTRACT

A log splitter for removable attachment to a tractor by means of modifications to a three point hitch conventionally installed thereon. Hoist bars are connected to the three point hitch and they force the log against a fixed splitter.

8 Claims, 5 Drawing Figures

LOG SPLITTER AND ATTACHMENT FOR TRACTOR

FIELD OF INVENTION

This invention relates to a log splitter, more particularly to an attachment to a tractor for splitting logs by attachments to a three point hitch conventionally installed on same.

BACKGROUND OF INVENTION

Most log splitters now extant hydraulically push the log to be split mounted horizontally on a beam surface against a fixed splitter blade. Typical devices of this design are U.S. Pat. No. 3,280,864 to Spanenberg, U.S. Pat. No. 4,076,062 to Kanik and U.S. Pat. No. 4,103,724 to Braid, all of which are pivotally mounted for transport by a tractor, pick-up truck or other vehicle. Other devices of similar design have been described in U.S. Pat. Nos. 3,938,567 to Dircksen et al, 3,760,854 to Worthington and 3,319,675 to Bles. These latter log splitters are adapted for use with a tractor, but also use a force horizontally applied to split a log mounted parallel to the earth. In these inventions, the beam upon which the log rests during the splitting action can be raised for ease of transport.

A third embodiment of the basic log splitter described above is illustrated by U.S. Pat. No. 3,780,779 to Guy. Here, the beam frame is adapted for attachment to a front end loader. The piston cylinder unit, normally attached to the bucket of the loader, is disconnected during use, the log being placed on the beam and between the piston and a splitting wedge. Williams, U.S. Pat. No. 4,019,549, is similar, utilizing a backhoe secondary boom to obtain the horizontally applied force.

The closest art to the present invention is U.S. Pat. No. 4,112,985 to Gosselin who discloses a splitter for permanent installation to a three point hitch at the rear of a tractor. Unlike the above cited prior art, Gosselin utilizes a vise-like member to apply a downwardly disposed vertical force against an upright log. The hitch itself performs no function except to support the vice like member, or to elevate the splitter during transit. The cutting action is obtained by a cutting arm hydraulically mounted and pivotable at the top of the vice like member.

Each of the log splitters above described is a unit separate and apart from the hitch, the hitch itself playing no part in splitting the logs.

SUMMARY OF INVENTION

It is an object of this invention to provide a log splitter for cutting logs mounted vertically, the force applied upwardly and against a securable splitting blade.

It is a primary object of this invention to utilize a three point hitch in modified form to split said logs.

It is a further object of this invention to provide a method for modifying said three point hitch for use as a log splitting device.

It is another object of this invention to provide a modified three point hitch for use as a log splitter, said modifications thereto being temporary.

These and other objects and features of the invention will be disclosed in the description below, a summary of which follows.

The log splitter comprises a first and second hoist bar each of which is mounted pivotably to the rear of a tractor chassis, preferably by hitch links mounted on the axle. Each hoist bar extends outwardly in spaced apart relationship to one another, a draw bar being attached fixedly therebetween proximate the outermost ends of said bars. A base plate for mounting the logs in an upright position is secured essentially in the center of the draw bar. A third bar, referred to as the splitter bar and having a splitter blade mounted at its outermost extension, is pivotably mounted to the chassis of the tractor at its other end. A support bar, also extending from the rear of the tractor, and pivotably mounted thereto, has a plurality of support stations proximate to its outermost ends, the support stations being adapted to secure the splitter bar at a fixed elevation relative to the ground, and to secure the splitter bar from horizontal movement.

Each hoist bar is connected to hydraulic or pneumatic lift means conveniently located in the rear of the tractor. A log to be severed is placed upright on the base plate, the hoist bars then being in their lowermost position, and the splitter blade positioned at or in line with the top of the log. The support bar is placed to fix the blade into an immovable position. As the lift means raise the hoist bars, the log is forcibly directed against the fixed blade thereby cutting the log in half.

DESCRIPTION OF INVENTION

Figure 1:
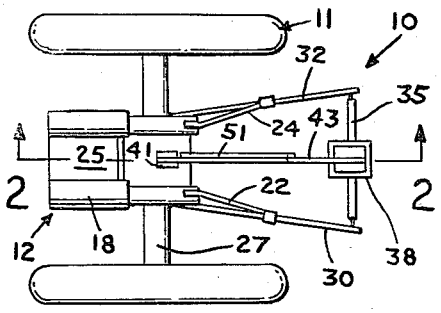
FIG. 1 is a plan view of the log splitter of the present invention.
Figure 3:
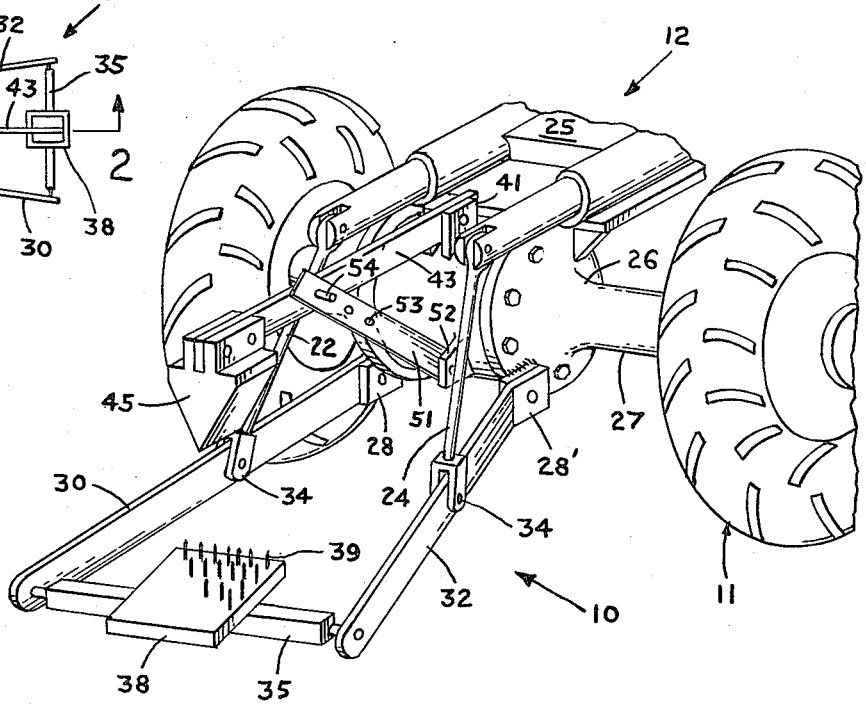
FIG. 3 is a perspective view of the log splitter in the lowered position.
Figure 2:
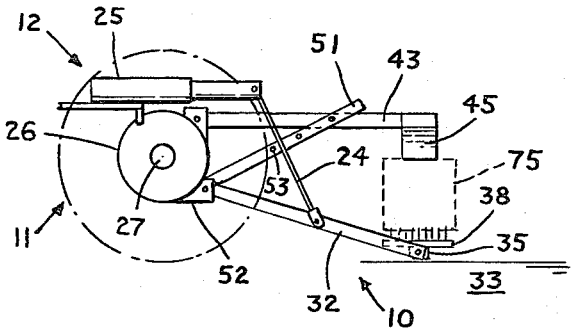
FIG. 2 is a cross sectional side elevational view of the log splitter of the present invention across section 2—2.

Referring to FIG. 3, the log splitter 10 is shown as installed at the rear of tractor 11, partially shown. FIGS. 1 and 2 may also be referred to for a better understanding of the invention. Numeral 12 designates the lift means, shown here as a hydraulic hoist assembly. The housing frame 25 of the lift means 12 is secured to differential gear housing 26 located on axle 27, which is here defined as part of the tractor chassis. While hydraulic means are shown, pneumatic means can be used as is conventional in the art. Various fluid supply lines and controls have not been shown inasmuch as these items are well known to a skilled mechanic. Suffice it to say that these controls and supply lines are conventional to the standard three point hitch in common usage.

Extending outwardly from each side of housing 26 and pivotably attached to respective hitch links 28, 28' connected thereto are two side hoist bars 30, 32 shown in their lowermost position. That is, these hoist bars drop to the vicinity of the earth 33. The hoist bars 30, 32 are spaced by the width of the draw bar 35, as illustrated in FIG. 1, a plan view of the invention. Lifting rods 22, 24 are pivotably connected to the hoist bars 30, 32 respectively by means of pins 34. While the hitch links 28, 28' are shown connected to the housing 26, it should be understood that said hitch links may be attached to any convenient chassis structure which will supply sufficient support.

Between the hoist bars, a draw bar 35 is mounted which assists in keeping the hoist bars properly diverged. The connection is rigid, that is, the draw bar is not free to rotate about its axis. Mounted approximately mid point of the draw bar 35 is base plate 38 having a plurality of log securing spikes 39. Welding, bolting, or other similar means may be used to secure the plate. However, for rapid disassembly, bolting is the preferred method of attachment.

Figure 4A:
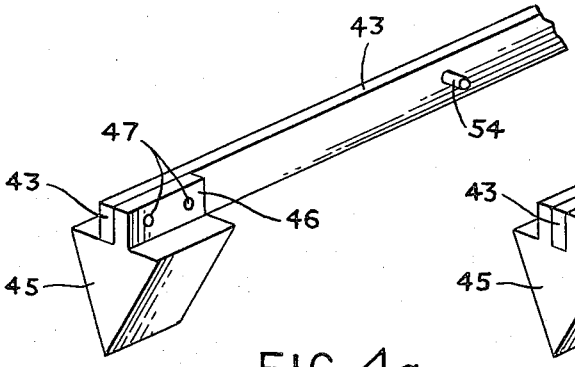
FIGS. 4*a* and 4*b* are detail views of two embodiments of the splitter blade.
Figure 4B:
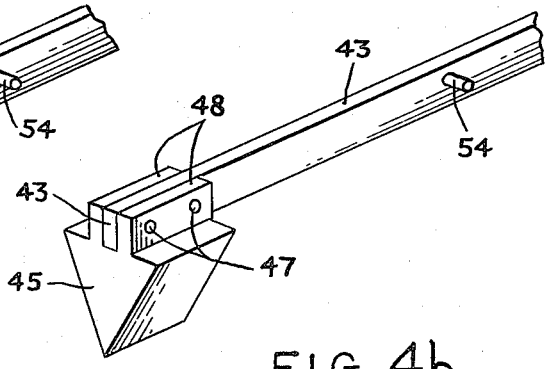

From a hitch link 41 positioned centrally atop housing 26 or on frame 25 (not shown), a splitter bar 43 extends outwardly, its length being as necessary to position the splitter head 45 over the log positioned on the base plate. The wedge shaped splitter blade 45 is attached to the splitter bar proximate to its outermost end as shown in detail in FIG. 4. As seen in FIG. 4*a*, the bar 43 may be mounted alongside a flange 46 extending upwardly from the blade 45. Mounting means may be welding, bolting, and the like. In FIg. 4*a* bolts 47 are shown connecting the bar 43 to the flange 46. Conversely, as illustrated in FIG. 4*b*, the preferred means of attachment is to place the bar 43 into a through slot comprised of two flange sections 48. In each embodiment it is preferred that the blade and flange be of unitary design for added strength.

Referring back to FIG. 3, a support bar 51 is pivotably attached to another hitch link 52 mounted centrally to housing 26, but below the first hitch link 41. Along the length of the support bar 51 are placed a plurality of support means 53 for adjusting the the height of splitter bar 43. In the embodiment shown the support means 53 are holes which can receive support pin 54. Other support methods are possible, the important feature, being means to hold the splitter bar in a fixed location.

To use the log splitter of the present invention, a log 75 (shown in FIG. 2) is secured onto the spikes 39 of base 38, the splitter blade 45 having been secured into position. Once the splitter bar 43 has been fixedly secured by support bar 51, the operator may, through actuation of the pneumatic or hydraulic system controls (not shown), raise the draw bar 35. The upward force against the stationary splitter blade shears the log to be split along its length.

The above description of the preferred embodiment of the invention is intended to convey the concept of invention to one skilled in the art, and is limited only by the claims which appear as follows.

I claim:

1. A log splitter adapted for removable attachment to the rear of a tractor or similar vehicle comprising:

(a) a first and a second hoist bar each mounted pivotably to the rear of said vehicle and extending outwardly therefrom in spaced apart relationship to one another;

(b) a draw bar attached fixedly between the outermost ends of said hoist bars, and having a base plate mounted thereto;

(c) a splitter bar mounted pivotably to the rear of said vehicle and extending outwardly therefrom, said splitter bar being essentially central to the hoist bars and having a splitter blade proximate to its outer end;

the log splitter characterized by:

(d) a support rod mounted pivotably to the rear of said vehicle and extending outwardly therefrom, said rod adapted along its length for adjustable connection to the splitter bar so that the height of the splitter bar can be fixedly defined;

(e) means for preventing lateral movement of the splitter bar, and (f) means for elevating the hoist bars, whereby a log vertically placed between the plate and the blade is split longitudinally by the application of an upward force against the stationary blade.

2. The log splitter of claim 1 wherein the splitter blade is wedge-shaped having a flange extending therefrom, said flange being side mounted to the splitter bar.

3. The log splitter of claim 1 wherein the splitter blade is wedge-shaped having a through slot at its top, the splitter bar extending into said slot.

4. The log splitter of claim 1 wherein the elevating means is a hydraulic hoist assembly of the tractor.

5. The log splitter of claims 1 or 4 wherein the hoist bars and support bar are mounted to the vehicle chassis below the plane of the axle, and splitting bar is mounted to the vehicle chassis above the plane of the axle, the mounting means being hitch links.

6. The log splitter of claim 5 wherein the hoist bars, support bar and splitting bar are mounted to the differential gear housing.

7. The log splitter of claim 5 wherein the splitting bar is mounted to the elevating means, said means being considered part of said vehicle chassis.

8. The log splitter of claim 5 wherein the base plate is detachable.

* * * * *